US008713818B2

(12) United States Patent
Doerer et al.

(10) Patent No.: US 8,713,818 B2
(45) Date of Patent: May 6, 2014

(54) CUSHIONED SHOE CONSTRUCTION

(75) Inventors: Daniel M. Doerer, Town & Country, MO (US); Mark J. Schauster, Highland, IL (US)

(73) Assignee: Brown Shoe Company, Inc., St. Louis, MO (US)

( * ) Notice: Subject to any disclaimer, the term of this patent is extended or adjusted under 35 U.S.C. 154(b) by 743 days.

(21) Appl. No.: 12/357,616

(22) Filed: Jan. 22, 2009

(65) Prior Publication Data

US 2009/0188131 A1 Jul. 30, 2009

Related U.S. Application Data

(60) Provisional application No. 61/023,118, filed on Jan. 24, 2008.

(51) Int. Cl.

| | |
|---|---|
| ***A43B 13/18*** | (2006.01) |
| ***A43B 13/40*** | (2006.01) |
| ***A43B 13/38*** | (2006.01) |
| ***A43B 7/12*** | (2006.01) |
| ***A43B 7/14*** | (2006.01) |
| *A43B 13/12* | (2006.01) |

(52) U.S. Cl.

CPC . *A43B 7/12* (2013.01); *A43B 7/144* (2013.01); *A43B 13/188* (2013.01); *A43B 13/12* (2013.01)

USPC ..... 36/30 R; 36/103; 36/35 R; 36/28

(58) Field of Classification Search

CPC ..... A43B 13/00; A43B 13/12; A43B 13/40; A43B 13/41; A43B 13/38; A43B 13/16; A43B 13/188; A43B 7/1425

USPC ..... 36/88, 103, 107, 30 R, 31, 35 R, 28

See application file for complete search history.

(56) References Cited

U.S. PATENT DOCUMENTS

| | | | | |
|---|---|---|---|---|
| 4,557,060 | A | 12/1985 | Kawashima | |
| 4,633,877 | A | 1/1987 | Pendergast | |
| 4,674,204 | A | 6/1987 | Sullivan | |
| 4,783,910 | A * | 11/1988 | Boys et al. | 36/107 |
| 4,794,707 | A * | 1/1989 | Franklin et al. | 36/107 |
| 4,910,886 | A | 3/1990 | Sullivan | |
| 4,930,232 | A | 6/1990 | Engle | |
| 4,942,679 | A * | 7/1990 | Brandon et al. | 36/102 |
| 5,099,588 | A | 3/1992 | Scholl | |
| 5,282,326 | A * | 2/1994 | Schroer et al. | 36/44 |

(Continued)

FOREIGN PATENT DOCUMENTS

| | | |
|---|---|---|
| CN | 2038725 U | 6/1989 |
| CN | 1210450 A | 3/1999 |

*Primary Examiner* — Jila M Mohandesi
(74) *Attorney, Agent, or Firm* — Husch Blackwell LLP

(57) ABSTRACT

A shoe construction including a shoe upper, an intermediate composite structure and an outsole. The composite structure underlies at least a portion of the upper and overlies at least a portion of the outsole. The composite structure includes cushion members with one cushion member being positioned to underlie a heel of a wearer and another cushion member being positioned to underlie the ball of the foot. The cushion member underlying the ball may be perforated. The composite structure can also include a relatively rigid lower member which can be perforated in the area of the ball of the foot underlying the cushion member for the ball of the foot. The composite structure can provide a flexure discontinuity in the shoe forward of the midfoot zone of the shoe.

18 Claims, 8 Drawing Sheets

(56) References Cited

U.S. PATENT DOCUMENTS

| | | | | |
|---|---|---|---|---|
| 5,311,677 | A | 5/1994 | Mann et al. | |
| 5,435,078 | A | 7/1995 | Pyle | |
| 5,467,536 | A | 11/1995 | Ramer | |
| 5,542,196 | A | 8/1996 | Kantro | |
| 5,718,064 | A | 2/1998 | Pyle | |
| 6,038,790 | A * | 3/2000 | Pyle et al. | 36/30 R |
| 6,061,929 | A * | 5/2000 | Ritter | 36/107 |
| 6,092,251 | A | 7/2000 | Tomat | |
| 6,453,578 | B1 | 9/2002 | Yung | |
| 6,508,017 | B1 | 1/2003 | DeBarro | |
| 6,532,594 | B1 | 3/2003 | Barnett | |
| 6,675,501 | B2 | 1/2004 | Pfander | |
| 6,874,257 | B2 | 4/2005 | Erickson | |
| 6,922,914 | B2 | 8/2005 | Pfander | |
| 7,082,704 | B2 | 8/2006 | Throneburg | |
| 7,171,764 | B2 | 2/2007 | Pfander | |
| 7,637,034 | B2 * | 12/2009 | Ailey et al. | 36/44 |
| 7,670,501 | B2 * | 3/2010 | Younes et al. | 252/182.24 |
| 7,681,333 | B2 * | 3/2010 | Dardinski et al. | 36/100 |
| 7,685,741 | B2 * | 3/2010 | Friedman | 36/25 R |
| 7,765,717 | B2 * | 8/2010 | Van Dyck | 36/3 B |
| 2004/0237341 | A1 | 12/2004 | Issler | |
| 2005/0071935 | A1 | 4/2005 | Shah et al. | |
| 2006/0026865 | A1 | 2/2006 | Grisoni et al. | |

* cited by examiner

CUSHIONED SHOE CONSTRUCTION

RELATED APPLICATIONS

This application is a non-provisional application claiming priority to provisional Patent Application Ser. No. 61/023,118 filed Jan. 24, 2008, the entire disclosure of which is incorporated herein by reference.

BACKGROUND OF INVENTION

The present invention relates to a shoe construction with improved comfort. Throughout the years, shoes have been made lighter, more durable and more comfortable. Numerous patents have been issued relating to structures attempting to accomplish this goal. Typically, some comfort has been achieved by the addition of cushioning to a shoe construction, for example, the providing of foam or gel pad inserts and foam or gel inserts. Gels have been used for comfort, particularly shock absorption for impact, for example, during running or exercising. Numerous combinations of components have been used in shoes to provide comfort. See for example U.S. Pat. No. 5,311,677 that shows a multi-layered structure providing various foam members in the heel, the forefoot and midfoot regions of the shoe. The shoe uses a foam cushion 58 and a foam composite structure 48, the first being located in the heel area and the second being located in the midfoot and forefoot portions of the shoe. The foam 48 is perforated and lies directly on the outsole. A liner is also provided in the forefoot area. A fiberboard portion 16 is also provided under the arch area of the shoe. The flexibility of the front portion of the shoe would be affected by the thickness of outsole which appears to be relatively thick. The foam layer 58 is disclosed as being about 3/16 inch thick except in the heel area where the foam is about 5/16 inch thick. The foam layer 48 is disclosed as being about 1/8 inch thick to about 3/16 inch thick. Holes 54 can be provided to influence the compression characteristics of the foam layer and are disclosed as being provided over the entire area of the foam layer.

U.S. Pat. No. 5,542,196 discloses an insole construction.

U.S. Pat. No. 6,038,790 discloses a flexible sole with a cushioned ball and/or heel region.

U.S. Pat. No. 4,674,204 discloses a shock absorbing insole, a method for preparing the insole that contains shock absorbing composite structure in the ball, heel or both sections of the shoe with the composite structure being composed of a polymer having greater shock absorbing properties and surface tack than the polymer employed in the molded heel and arch section.

Numerous other patents disclose various aspects of shoe construction.

While many improvements have been made, there is still a need for an improved light weight shoe construction particularly useful in women's shoes which require the same functionality as men's shoes, but typically with thinner construction and lighter weight.

SUMMARY OF INVENTION

The present invention involves the provision of a shoe construction having an upper shaped and sized to receive a foot portion of a wearer. The shoe construction also includes an outsole for engagement with the ground or other walking surface. An intermediate composite structure is provided that is positioned in overlying relation to the outsole and for support of a wearer's foot. The composite structure includes a relatively rigid support member extending from a heel area to at least the ball area. A first cushion member is secured in overlying relation to an upper portion of the support member in a ball area of the shoe. The first cushion member provides a flexural discontinuity in the ball area transversely and longitudinally of the shoe in the ball area and forward of the midfoot portion of the shoe. The first cushion member and the support member can each have a plurality of perforations in the ball area. A second cushion member can be secured in a heel receiving area of the shoe. The composite structure can include a third cushion member in overlying relationship to the first cushion member and second cushion member.

BRIEF DESCRIPTION OF DRAWINGS

Like numbers throughout the various figures designate like or similar parts and/or construction.

DETAILED DESCRIPTION

Figure 1:
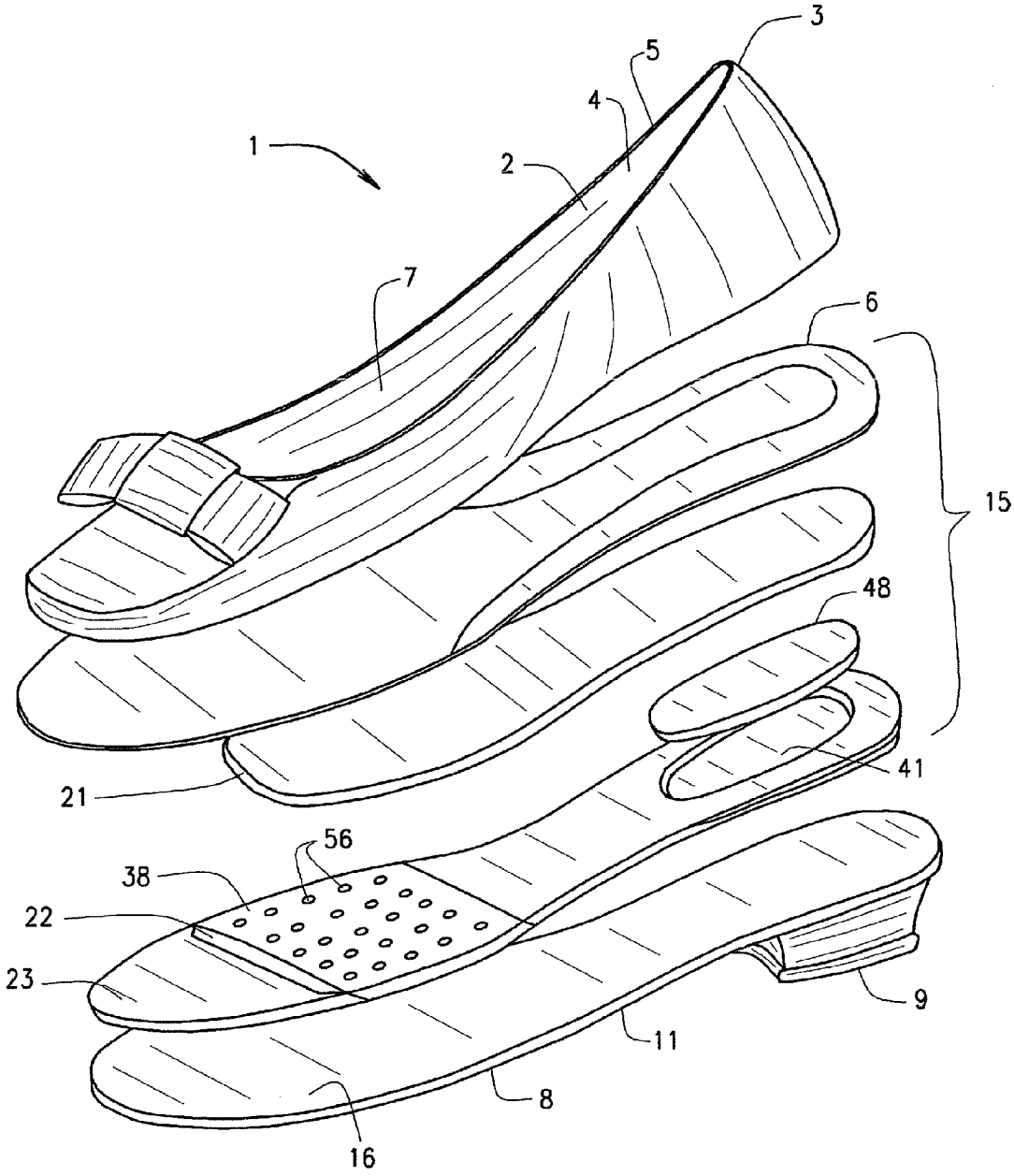
FIG. 1 is an exploded perspective view of a shoe showing various components thereof.

The reference numeral 1 designates generally a shoe construction as seen in FIG. 1. The shoe 1 includes an upper 3 that can be of any suitable style or shape having a foot opening 4 and is shown as having a sidewall 5 to form an enclosed slip on style top. Lace up sandals and thong type tops may be used. The sidewall 5 preferably is of a low style stopping below the ankle. A sock liner 6 may be provided that goes inside the foot receiving receptacle 7 of the upper 3 and may be a fabric, coated fabric, leather or other suitable material. The upper 3 may also include a lining 2 made of a breathable material. The liner 6 may be secured within the receptacle 7 as with a suitable cement. A preferred liner 6 includes a breathable material, i.e., the lining material prior to being secured in the shoe will allow full air transfer in 60 seconds or less when tested in accordance with ASTM D737. An outsole 8 is provided and is positioned on the underside of the shoe 1 for engagement with a walking surface such as the ground, sidewalk, floor or the like. The outsole 8 may also be provided with a heel 9 as is known. The heel 9 at the rear of the shoe 1 has a height of less than about 50 cm. The outsole 8 may be of any suitable material for example, leather, elastomer, polymer, a foamed polymer or elastomer, a composite thereof or the like depending upon the type of shoe desired. The outsole 8 has a bottom surface 11 for engagement with the walking surface and has the heel 9 secured thereto and extending downwardly therefrom in use. An intermediate composite structure designated generally 15 is provided and is positioned in overlying relation to an inside or upper surface 16 of the outsole 8.

The present invention relates to the construction of the composite structure 15 and its combination with the other elements of the shoe 1, the upper 3, heel 9 and outsole 8.

The foot of a human may be considered to have three regions, the forefoot i.e., adjacent to and including the toe area, the midfoot and the hind foot adjacent the heel. The midfoot is that area between the forefoot and the hind foot. The forefoot region is designated generally A, the midfoot region is designated generally B, and the hind foot region is designated generally C in FIG. 3. The ball of the foot is generally the area of the foot at the juncture between the metatarsal bones and the phalange bones. The two primary regions of the foot for load bearing during normal walking and standing are the heel area and the ball area. The major flexure or bending of the shoe during normal use occurs at least in the area of the ball. The arch or instep is positioned between the heel and the ball in a human foot and flexes little during normal walking. The forefoot A includes the toe area or zone D and the ball area or zone E of a shoe 1 and foot (not shown).

Figure 2:
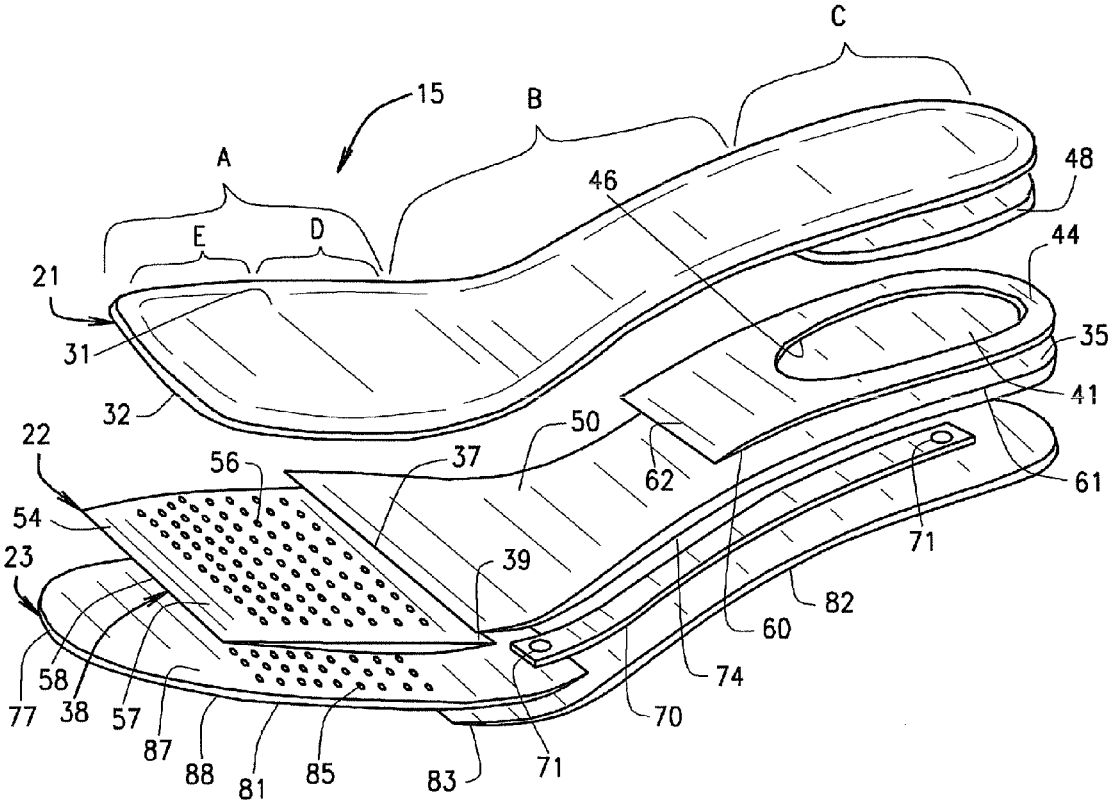
FIG. 2 is an exploded perspective view of a shoe intermediate composite structure.
Figure 3:
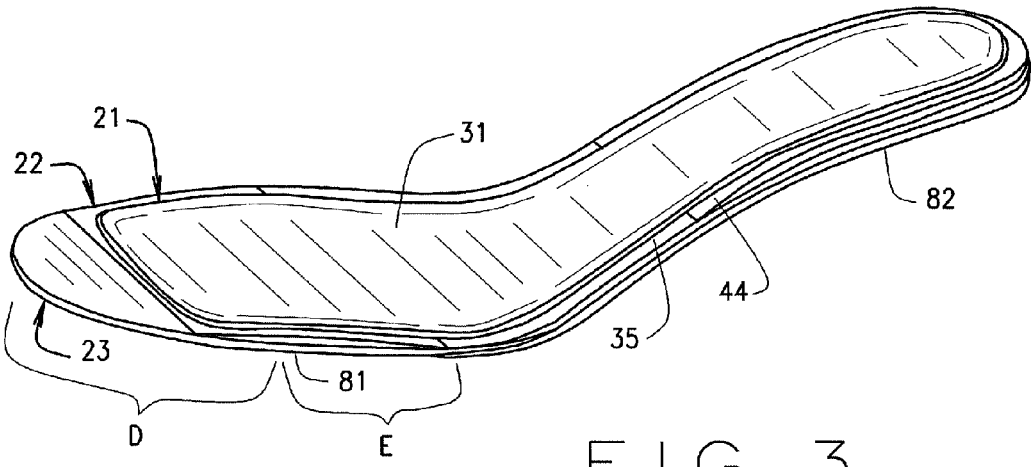
FIG. 3 is a perspective view of the composite structure shown as assembled.

The composite structure 15 of the shoe of FIGS. 1-3 is preferably comprised of three superposed layers designated generally 21, 22, 23 (FIG. 2) and the liner 6. The components of the composite structure 15 are preferably secured together as by cementing and the composite structure is preferably provided as an integral unit during assembly of the shoe 1, although, the liner 6 need not be secured to underlying layers. Joining the components together prevents relative movement therebetween during assembly and use of the shoe 1. The composite structure 15 may also include an insole board (not shown) of a relatively rigid material such as Texon fiberboard. The layers 22, 23 together may also be considered an insole.

The upper layer 21 can be a molded foam layer for example, cellular type non-rigid foam and depending upon the particular characteristics needed in the layer 21, the material can be an open cell or a closed cell foam. The layer 21 can also be a styrene block copolymer, a silicone gel or a polyurethane such as Sorbothane as is known. Preferably, the hardness of layer 21 is in the range of between about 42 and about 55 Shore O and its thickness may be uniform or contoured and is preferably in the range of between about 1/16 inch and about 5/32 inch (1.6 mm to 4 mm). A particularly suitable foam is a latex foam. The layer 21 has an upper surface 31 and a lower surface 32. The upper surface 31 is positioned and oriented for engagement with at least a bottom portion of the liner 6 or a bottom portion of the upper 3 for securement thereto.

In the illustrated structure, the layer 22 is comprised of a plurality of components in superposed relationship. As shown, there is a heel/midfoot board 35 that extends from the rear of the shoe forward to an area adjacent the rear of the ball portion E of the shoe 1. The board 35 is relatively rigid and preferably of a rigid pressed fiberboard material such as Texon and has a thickness in the range of between about 1/32 inch and about 1/16 inch (0.8 mm to 1.6 mm). The forward edge portion 37 of the board 35 may be beveled (skived) front to rear for joinder to a cushion pad member 38 to provide a smooth transition between the board portion 35 and the pad 38. The pad 38 may be suitably joined as by cementing to the board 35 as at 39 and is flexible, e.g., a non-rigid foam pad, e.g., latex foam, with hardness as described below. The pad 38 may also be a silicone gel. The pad 38 may be of a uniform thickness or may be contoured having thickness in the range of between about 1/16 inch and about 3/32 inch (1.6 mm to 2.4 mm) at least in its central region. The pad 38 extends transversely of the shoe 1 and preferably at least about 60% of the shoe width in the area of the pad in the ball zone D and more preferably substantially the entire width between opposite sides of the shoe 1 and is positioned for underlying the ball portion of the foot of the wearer. The pad 38 provides a discontinuity of flexibility in the composite structure 15 and in its co-action with the outsole 8. The pad 38 provides a flexural discontinuity in the shoe 1 increasing flexibility of the composite structure 15 at least by about 25% in the ball zone E relative to the flexibility of the composite structure in the midfoot portion B of the shoe 1 shown in FIGS. 1-3. The outsole 8, in the ball zone B, preferably has a thickness of less than about 6 mm and preferably less than about 4 mm for a formed or assembled outsole 8 (generally referred to as a cement construction in the art) and preferably less than about 9 mm when of a unit molded construction. When the outsole 8 is of a unit molded construction, for any of the outsole embodiments it preferably has density less than about 0.9 g/cc and preferably in the range of between about 0.5 g/cc and about 0.9 g/cc. The pad 38 preferably extends longitudinally of the shoe 1 at least about 3 cm. The pad 38 forms the flexural discontinuity in the shoe forward of the midfoot portion B which discontinuity extends transversely and longitudinally of the shoe. As shown, the rearward portion of the pad 38 underlies a forward portion of a board 35 and may be suitably secured as by cementing together in the overlapping region. In the illustrated preferred embodiment, the layer 22 is provided with a pocket 41, e.g., within heel counter portion 44, suitably secured as by cementing to an upper surface 50 of the board 35. The leading edge portion 54 of the foam pad 38 may also be beveled if desired, for comfort. As illustrated, the pad 38 is provided with a plurality of perforations 56 extending between and opening onto the upper and lower surfaces 57, 58 respectively. The perforations 56 may be formed during a molding process or may be formed afterwards as by a die or punch cutting process.

The pocket or recess 41 is provided and may be formed in the board 35 directly or may be provided in an overlying spacer board member preferably in the form of a heel counter 44 or both providing an upwardly opening recess 41. As shown, the heel counter 44 is preferably relatively rigid and generally flat but could be curved at the side and rear edges to provide a cup shape if desired. The edge 46 defining the recess 41 may also function in a manner similar to an upturned lip portion of a heel counter. A cushion member pad 48 is positioned in the recess 41. The pad 48 may be made of any suitable material like the pad 38. Preferably, the pad 48 is molded to shape and is not die cut. The pad 48 may be secured in position in the recess 41 as with a suitable cement. The thickness of the pad 48 and its hardness are such as to reduce the wearers' sensing of the edge defining the side of the recess 41 with hardness as described below. The pad 48 may be of a uniform thickness or contoured having thickness in the range of between about 1/16 inch and about 3/32 (1.6 mm and 2.4 mm) inch at least in its central region. The depth of the recess 41 is preferably about equal to or less than the normal thickness of the pad 48. The heel counter 44 has a peripheral edge 60 that conforms generally to the peripheral edge 61 of the board 35. The leading edge 62 may be beveled to eliminate a transition bump between the heel counter 44 and the board 35. The heel counter 44 may be suitably secured to the board 35 as with a suitable cement or adhesive.

The pads 38, 48 have a density in the range of between about 0.5 g/cc and about 1 g/cc, including both foam and gel pads, and when it is a foam pad, preferably less than about 0.75 g/cc and preferably above about 0.5 g/cc. The pads 38, 48 have a deformability of between about 10% and about 60% and preferably between about 25% and about 50% in thickness when loaded at 15 psi. The pads 38, 38 have a hardness in the range of between about 42 and about 74 Shore O (per ASTM D 2240) with the pad 38 preferably having a hardness in the range of between about 42 and about 65 and the pad 48 having a hardness in the range of between about 61 and about 74 Shore O. The composite structure 15 (and those disclosed below) preferably has a composite density of less than about 1 g/cc and preferably less than about 0.75 g/cc and at least a majority of its thickness is less than about 9 mm and preferably in the range of between about 3 mm and about 9 mm and may vary along its length and across its width. The outsole 8 has a maximum width, i.e., the width at the widest part of the ball zone E at least about 0.30 times and preferably at least about 0.35 times the inside longest length of the shoe as is indicated by the shoe size.

A shank 70 may be provided as part of the illustrated composite structure 15 for example a steel shank, may be positioned between the layers 22, 23 in the midfoot portion B and the heel portion C. Shanks are known in the art. In the illustrated structure, the shank is secured to the layer 23 as with rivets 71.

The layer 23 underlies the bottom surfaces 58 and 74 of the layer 22. In the illustrated structure, the layer 22 overlies and is secured to the layer 23 as by cementing. The layer 22, as shown, terminates just short of the end 77 of layer 23. In the illustrated structure, the layer 23 has a plurality of portions, e.g., a fore portion 81 and hind portion 82. The portions 81 and 82 are joined together adjacent the midfoot portion B as at 83 wherein the overlapping regions of the portions 81, 82 are secured together as with a suitable cement. As shown, the shank 70 is secured directly to the fore portion 81 and directly to the hind portion 82. The heads of the rivets 71 are shielded from both the foot of the wearer and from the outsole and are preferably positioned to not be foot engaging to reduce the potential of discomfort. The fore portion 81 of the illustrated layer 23 is also perforated with a plurality of through holes or perforations 85 of the portion 81. The holes 85 and 56 are under the ball portion of a foot in the shoe 1. The holes 85 extend between the upper surface 87 and the lower surface 88. The perforations 56 and 85 can be similar and can be formed simultaneously as by a suitable cutting method, for example punching/die cutting, and are preferably on the order of between about 1/32 inch and about 3/32 (0.8 mm to 2.4 mm) inch in diameter and between about 3/16 inch and about 3/8 inch (2 mm to 4 mm) in spacing, both in the forward to rear direction and side to side direction. The trailing end of the fore portion 81 and the leading edge of the hind portion 82 can be tapered to provide smooth transitions therebetween on the top and bottom. Preferably, the fore portion 81 and hind portion 82 are made of a relatively rigid pressed fiberboard. A suitable fiberboard is Texon board. The composite structure 15 overlies and is preferably secured to the surface 16 of the outsole 8 and underlies the lining 6 and shoe upper 3 being sandwiched therebetween and secured thereto as by cementing. The thickness of the fore portion 81 and hind portion 82 is preferably in the range of between about 1/16 inch and about 3/32 inch (1.6 mm to 2.4 mm) except at the tapered portions.

Figure 4:
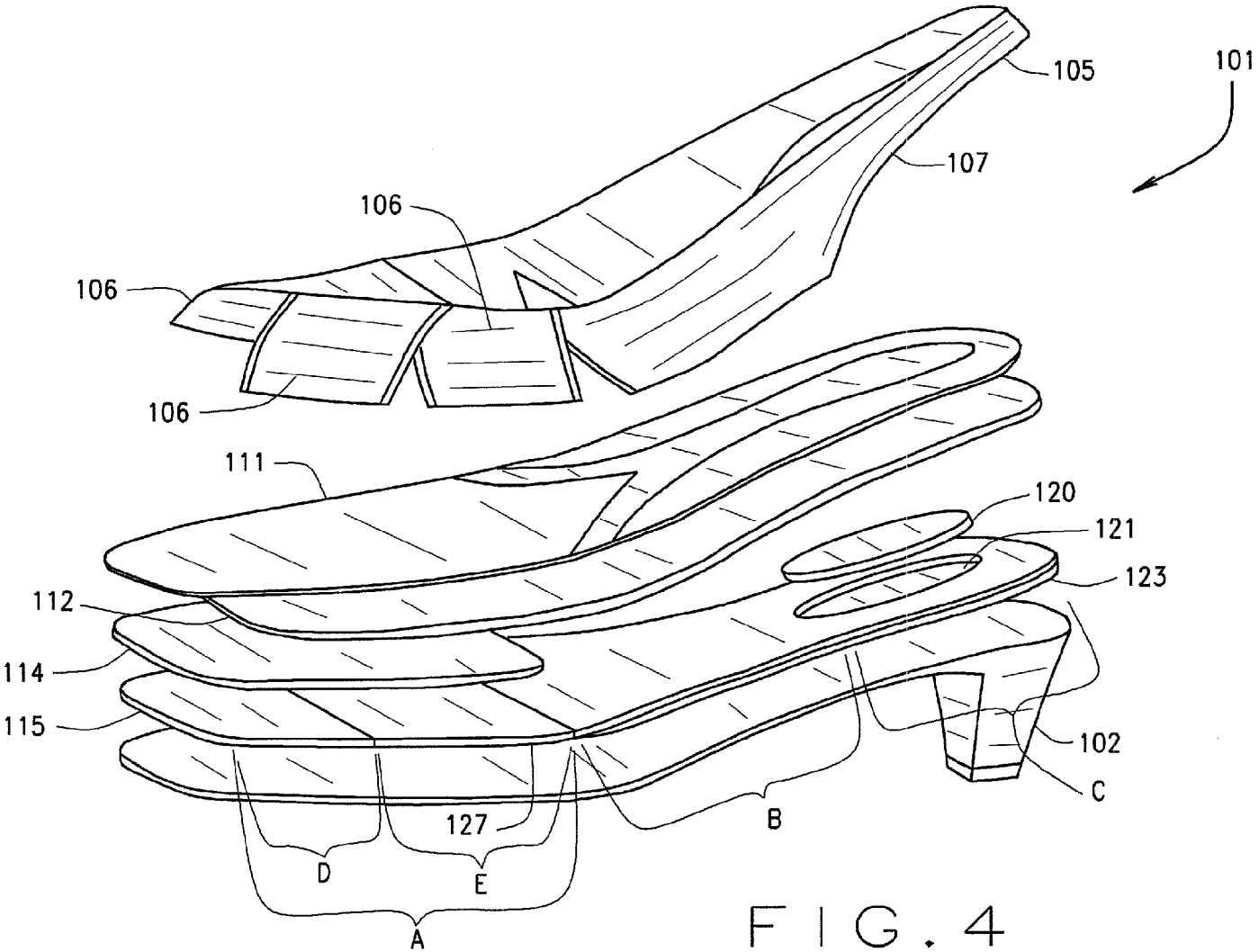
FIG. 4 is an exploded perspective view of the second embodiment of the shoe construction.

FIG. 4 illustrates an alternative embodiment of the present invention which illustrates a woman's shoe designated generally 101. The shoe 101 includes a heel 102 and an outsole 103. The outsole 103 and heel 102 are generally as described above for the outsole 8 and heel 9. The shoe 101 includes a shoe top 105 having over the toe straps 106 and a rear side wall and heel strap portion 107. The shoe upper 105 may be secured to the outsole 103 in any suitable manner. The shoe 101 is provided with a composite structure 108, similar to the composite structure 15, that comprises multiple layers of material including layers 111, 112, 114 and 115. The shoe 101 may also be provided with a ball zone pad 127 in the ball zone E like the pad 38 and a heel pad 120 similar to the heel pad 48 which is secured in place in a recess 121 like the recess 41.

In the illustrated structure, the layer 115 is comprised of a toe portion D which may be made from a pressed fiber board like Texon. The heel portion C and the midfoot portion B may be formed of a plurality of layers of relatively rigid material such as pressed fiber board, like Texon, joined together. The ball zone pad 127 is part of the layer 115 and is positioned between the toe portion D and the midfoot portion B providing a discontinuity in the flexure forward of the midfoot portion B. The pad 127 may be provided with perforations (not shown) like the perforations 56. Additional cushioning may be provided by the provision of the layers 112 and 114 which may be joined to the layer 115 as by cementing to facilitate assembly of the shoe. A sock liner 111 may also be provided and in the case of an open top shoe, would be preferably secured to the layer 112.

The general description regarding the heel height and materials of the construction for the form of the shoes shown in FIG. 4, and the below described shoe embodiments, are generally the same as those disclosed for the form of the shoe shown in FIGS. 1-3. The joinder of the pad 127 to the toe portion D and the midfoot portion B may also be as described above using skived junctures between the parts.

Figure 5:
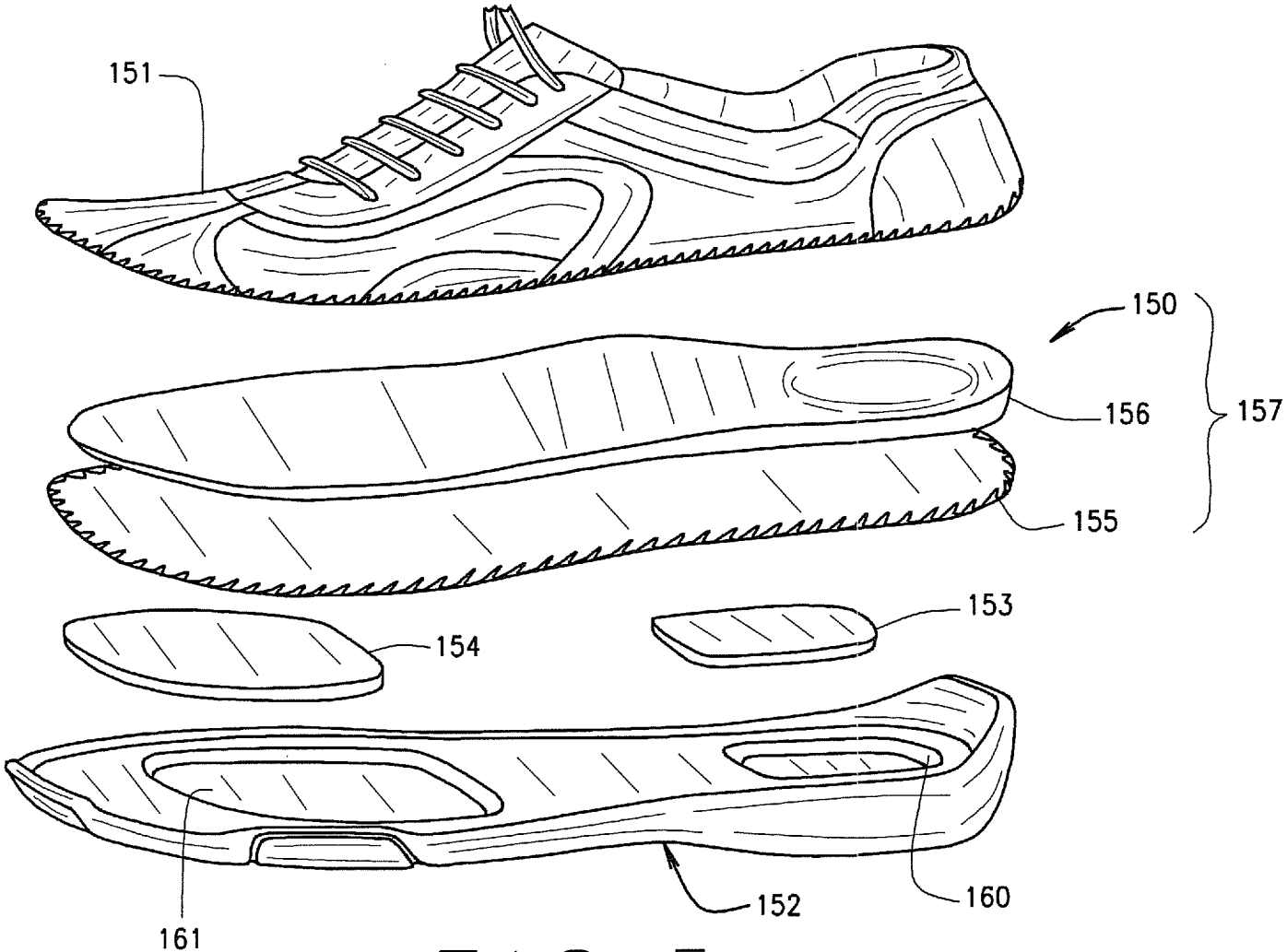
FIG. 5 is an exploded perspective view of a third alternative shoe construction.

FIG. 5 illustrates another embodiment of the present invention showing its use in a Strobel type shoe designated generally 150. The shoe 150 includes a lace type enclosed upper 151, an outsole 152, and composite structure 157 including cushion pads 153, 154 and layers 155, 156.

In the illustrated structure, the pads 153, 154 (like pads 48, 38 respectively) are secured in respective recesses 160, 161 formed in the outsole 152. And preferably, the pads 153, 154 are secured in place in the outsole 152. The outsole 152 may be formed of a thermoplastic polymer, thermoset polymer or vulcanized elastomer type material and may be molded prior to attachment to the other parts of the shoe 150. The pads 153, 154 may be secured in the recesses 161 prior to joining the upper 151 and the composite structure layers 155, 156 in place in the shoe 150 or molded to a formed upper 151. The pad 154 in combination with the recess 161 a flexural discontinuity and increases flexure by at least 25% in the ball zone E as compared to the midfoot portion B of the outsole 152 and/or composite structure 157. In the illustrated embodiment, the upper 151 is joined to the layer 155 as by stitching around the perimeter of the two components. Preferably, the layer 151 is non-woven fabric and may be provided with through openings to accommodate the pads 153, 154. These openings are not shown in FIG. 5. Preferably, the layer 156 is a molded footbed and can be made from a molded foam such as polyurethane or ethyl vinyl acetate (EVA). The composite structure comprising the footbed 156 layer 155 and pads 153, 154 can be secured to the outsole 152 as with a suitable cement. Preferably, the outsole 152 can be molded and can be made of a suitable foam material such as a thermoplastic, thermoset polymer or vulcanized elastomer.

Figure 6:
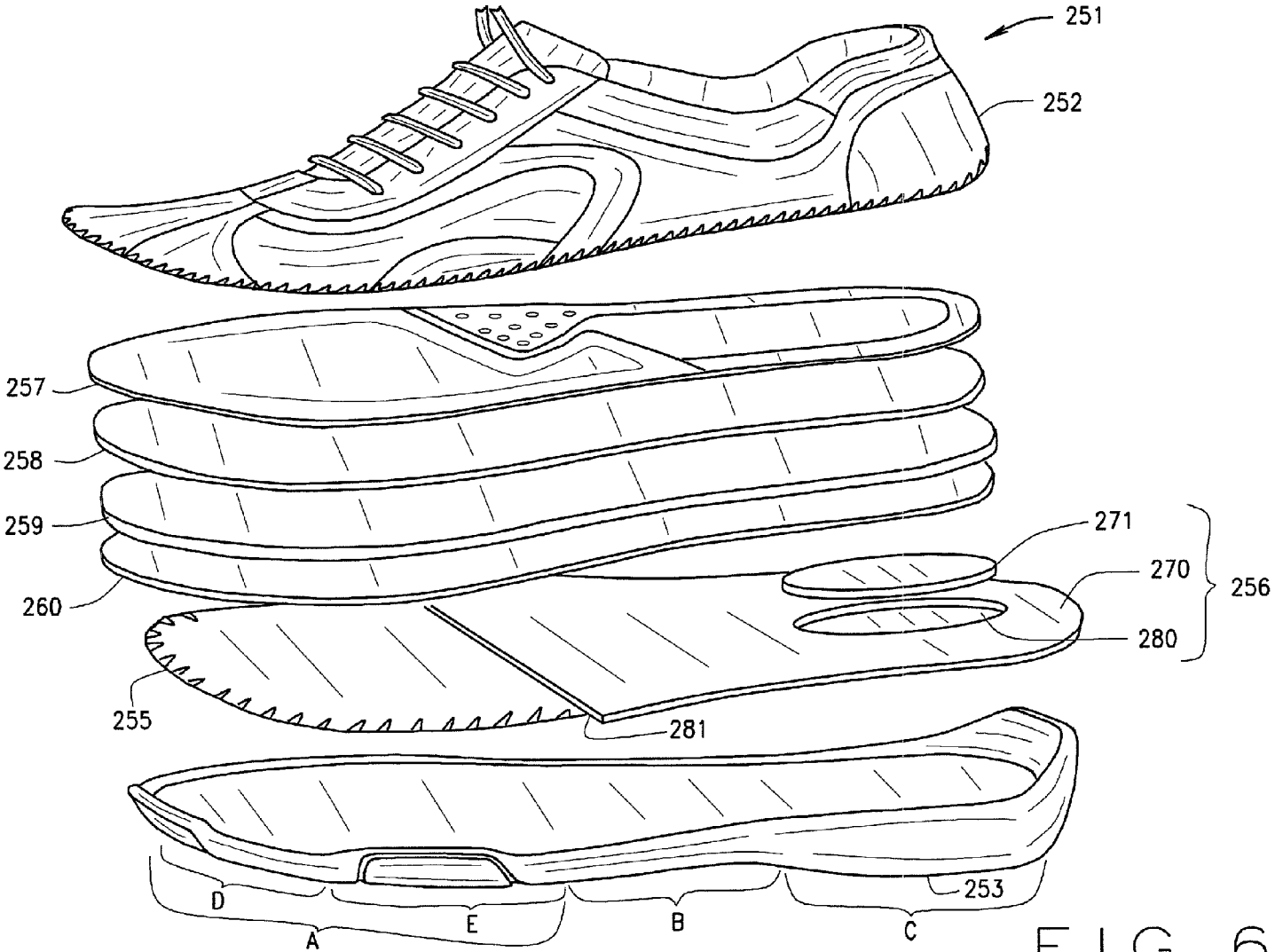
FIG. 6 is an exploded perspective view with of a fourth alternative design illustrating a Strobel type shoe.

FIG. 6 illustrates another embodiment of the present invention illustrating a shoe 251 of a Strobel type lace up shoe construction as seen in FIG. 5 but has a different composite structure construction to substitute for the separate cushion pads 153, 154 positioned in the outsole 152 of the construction shown in FIG. 5. In the form of a shoe shown in FIG. 6, the shoe includes an upper 252 and an outsole 253. The outsole can be of a unit molded construction and made from a material such as thermoplastic polymer, thermoset polymer or vulcanized elastomer. The upper 252 is joined to a portion of the composite structure 256 i.e., the layer 255 as by stitching around the perimeter of the upper 252 and layer 255. In the illustrated structure, the composite structure 256 also includes the layers 257, 258, 259 and 260 as well as a cushion member pad 271. The layer 257 can be sock liner and can be made of a material such as any covered or uncovered foam. The layers 258, 259 are preferably of a foam material extending from heel to toe. Preferably, the layers 258, 259 are made of a molded foam material similar to the pads 38, 48. The layer 260 can be a non-woven fabric as is known in the art. The layers 257, 258, 259 and 260 may be secured together or alternatively, the layers 258, 259 and 260 can be secured together while the layer 257 can be removable. Preferably, the layers 258, 259 and 260 are secured to the layers 255 and 270 and also the pad 271. In the illustrated structure, the layer 270 stops at the rear portion of the ball area E and can be made of a relatively rigid material such as Texon. It can be provided with a recess 280 for receipt therein of cushion pad 271 which can be similar in construction to the recess 41 and pad 48. The layers 258, 259 form a cushion pad forward of the leading edge 280 of the layer 270 and form a flexure discontinuity in the ball zone E forward of the midfoot portion B as described above. Preferably, the layers 258, 259 extend the entire width of the shoe 251 and have a thickness on the order of 3 mm to 5 mm each.

Figure 7:
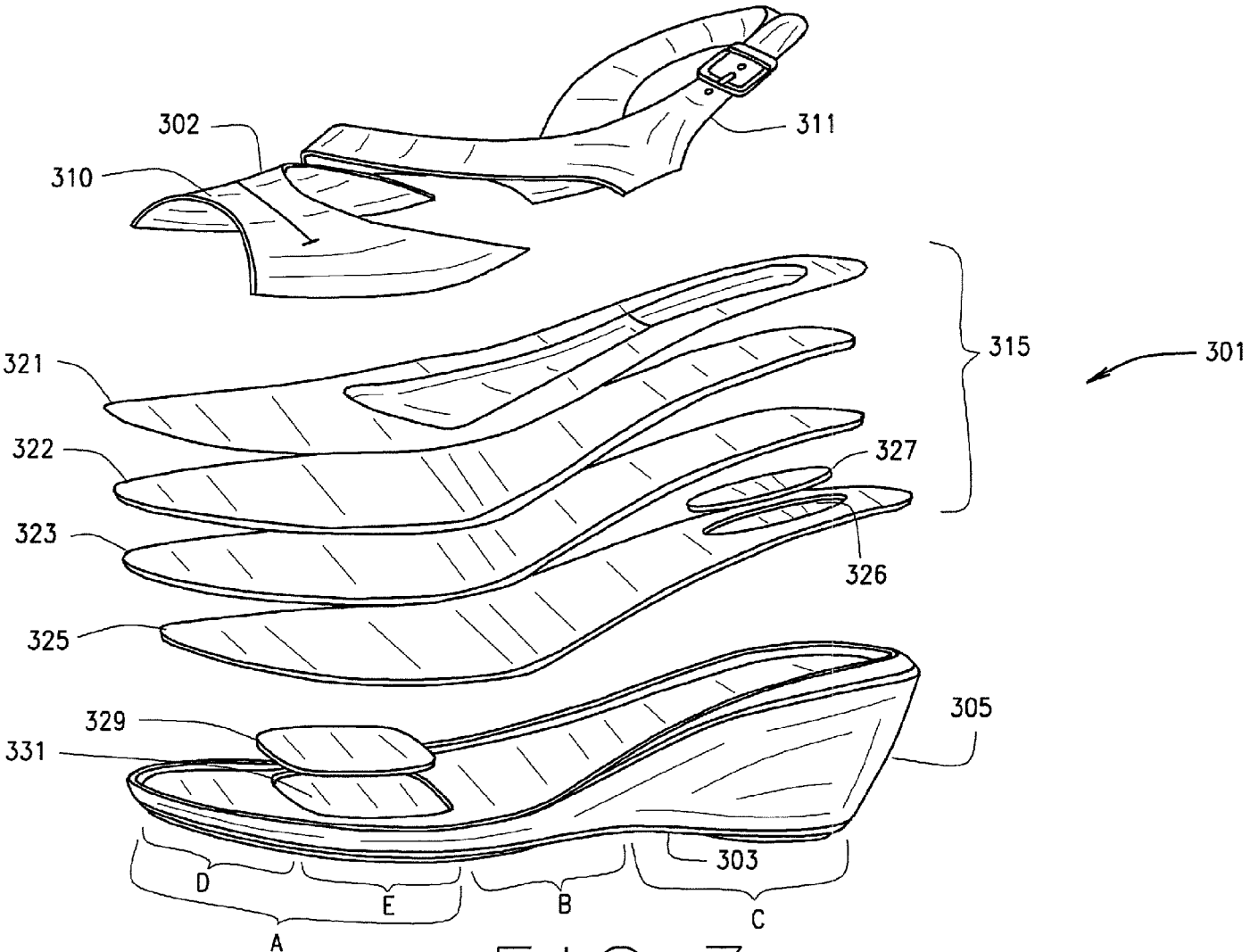
FIG. 7 is an exploded perspective view of a fifth alternative shoe construction illustrating the shoe as an open top shoe.

FIG. 7 shows another embodiment of the present invention in the form of an open top shoe 301 having an upper 302 and an outsole 303. The shoe 301 is shown as a wedge type shoe having a heel 305 extending forward into the midfoot portion B providing a relatively rigid shoe construction in the midfoot B and heel C zones. The upper 302 is of a sandal type having a toe cover portion 310 and a heel strap 311. The upper 302 is suitably secured to the outsole 303. The outsole 305 may be of a molded construction or of an assembled construction and may be made from a material such as thermoplastic polymer, thermoset polymer or a vulcanized elastomer. The composite structure 315 is shown as having a plurality of layers including a sock liner 321, a pair of foam layers 322, 323 and a relatively rigid bottom layer 325. The layers 322 and 323 can be made of a foam material such as latex foam having a thickness on the order of 2 to 5 mm each. The layer 325 can be made of a relatively rigid board material such as Texon having a thickness on the order of about 2 mm to about 4 mm. In the illustrated structure, all the layers 321, 322, 323, 325 extend from the heel to the toe of the shoe. The layer 325 can be provided with a recess 326 for the receipt therein of a cushion member pad 327 similar in construction to the pad 48. The composite structure 315 also includes a cushion pad 329 which can be similar in construction to the pad 38. In the illustrated structure, the pad 329 is received in a recess 331 formed in the upper surface of the outsole 303. Recess 331 and pad 329 forms a flexure discontinuity, as described above, in the ball zone E and forward of the midfoot portion B of the shoe 301. The layers 322, 323 and 325 may be secured together. The layer 321 may also be secured to those layers or may be removable.

Figure 8:
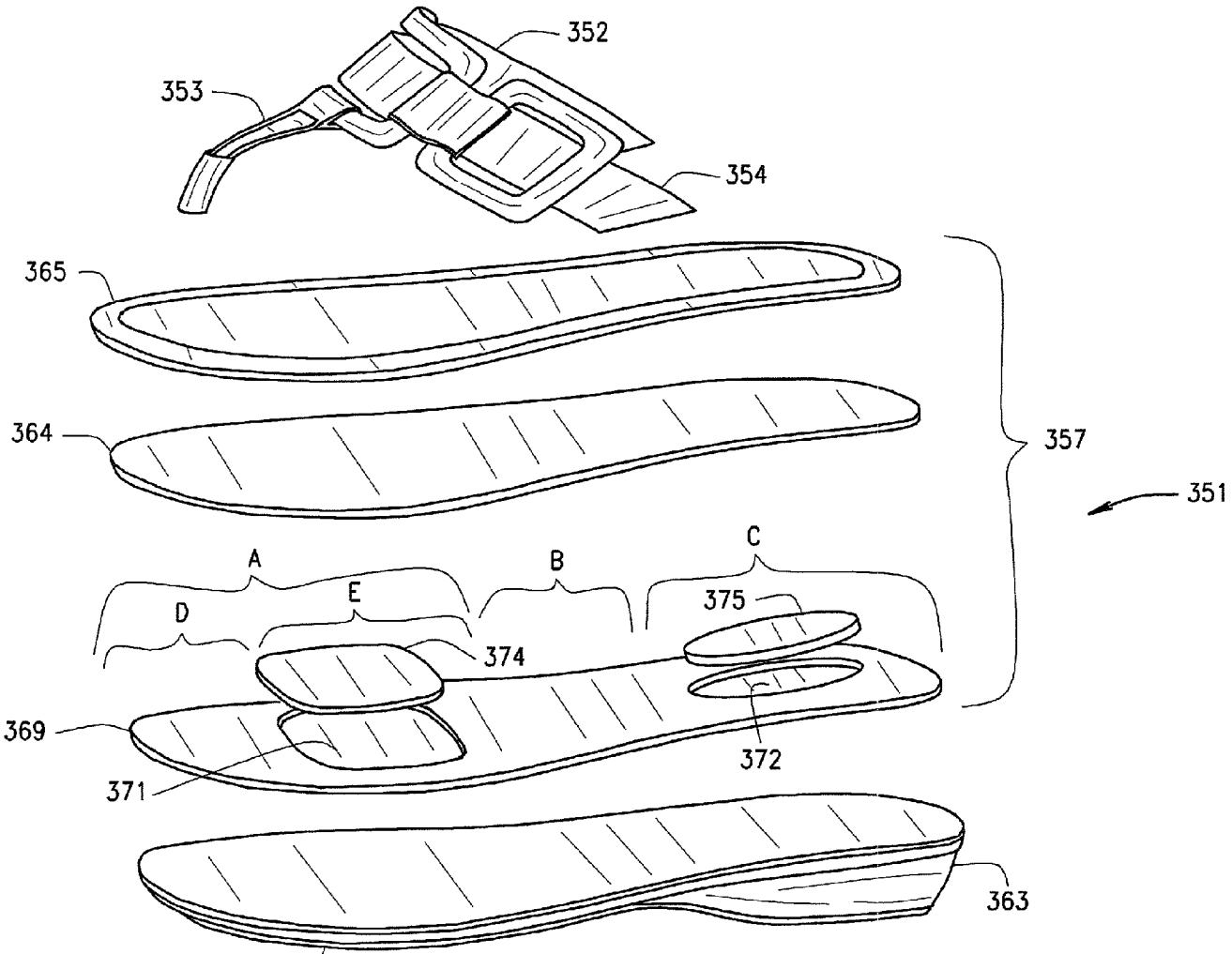
FIG. 8 is an exploded perspective view of a sixth alternative shoe construction illustrating the shoe as a sandal.

FIG. 8 illustrates a still further alternative embodiment of the present invention illustrating a shoe designated generally 351. As illustrated, the shoe is of a thong sandal style having an upper 352 suitably secured to an outsole either directly or indirectly and includes a toe strap 353 and a midfoot strap 354. The shoe 351 includes a composite structure 357 comprised of a plurality of layers. The composite structure 357 is secured to the outsole 353. Preferably, the outsole is made of a relatively rigid material such as thermoplastic polymer, thermoset polymer or vulcanized elastomer and can be of a unit molded or formed construction and having a heel 363 secured thereto. The composite structure 357 is illustrated as having three layers, a sock liner 365, an intermediate layer 367 made of a suitable cushion material such as foam having a thickness on the order of about 3 mm to about 6 mm. As illustrated, layers 365, 367 extend from the heel to the toe of the shoe in a continuous manner. The composite structure 357 includes a layer 369 which is suitably secured between the layer 367 and the upper surface of the outsole 353. As illustrated, the layer 369 extends from the heel to the toe of the shoe. The layer 369 includes a pair of recesses 371, 372 sized and shaped to receive therein respective cushion pads 374, 375. The pads 374, 375 are formed of a suitable foam material as described for the pads 38, 48, respectively. As illustrated, the pad 374 extends substantially the entire width of the outsole 353 and by the provision of the recess 371 and the flexure of the material forming the pad 374, a discontinuity in the flexure of the shoe 351 is provided in the ball zone E forward of the midfoot portion B as described above.

Figure 9:
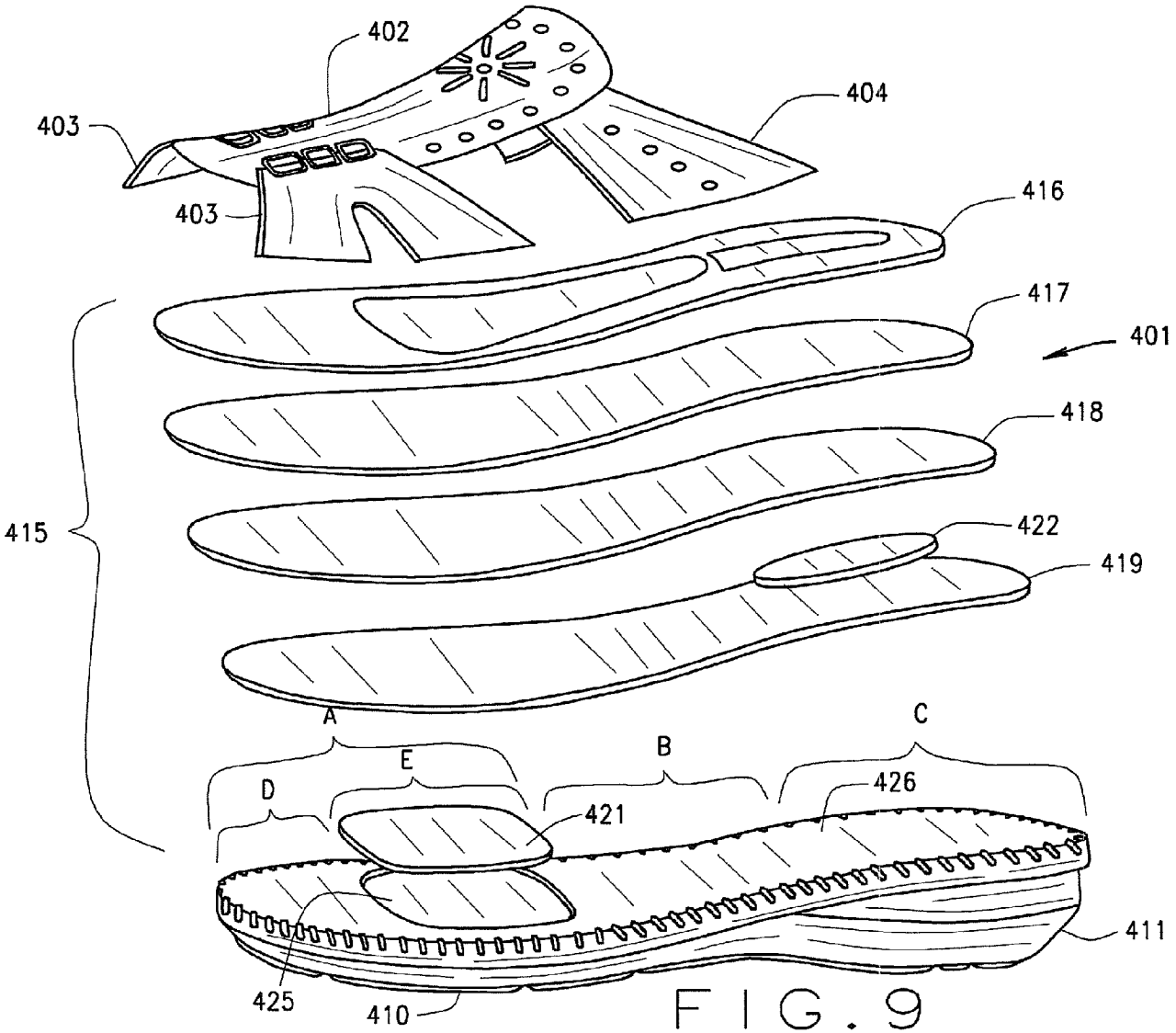
FIG. 9 illustrates a seventh alternative embodiment of the shoe construction illustrating the shoe as an open top shoe.

FIG. 9 illustrates an additional embodiment of the present invention. FIG. 10 illustrates an open top shoe of a sandal type designated generally 401. The shoe 401 includes an open top 402 having front and rear straps 403, 404 respectively. The shoe 401 includes an outsole 410 and a heel 411. In the illustrated structure, the outsole 410 and heel 411 are of an integral structure and preferably of a molded construction. A composite structure is provided and is designated generally 415 and includes layers 416, 417, 418, 419 and cushion pads 421, 422. The pads 421, 422 can be of a construction similar to that disclosed for the pads 38, 48, respectively, as described above. The outsole 410 is provided with a recess 425 opening onto the upper surface 426 of the outsole 410. The pad 421 is preferably secured within the recess 425. The rear edge of the recess 425 is at the back of the ball zone E. The pad 421 and recess 425 provide a discontinuity in flexure of the outsole 410 in the ball zone E as described above. The layer 416 may be a sock liner while the layers 417 and 418 can be flexible foam layers each having a thickness on the order of about 2 to 5 mm. The layer 419 can be of a non-molded construction and made from a relatively rigid material such as non-woven fabric. The pad 422 can be secured between the layers 418 and 419 and if desired, a pocket or recess may be provided in either of those layers to provide for the pad 422. The pad 421 can be of a foam material such as latex foam and can be on the order of 2 to 5 mm thick. The pad 421 extends generally between the opposite sides of the shoes a substantially portion of the width of the shoe in the ball zone E as described above for pad 38. In the illustrated structure, the forward edge of the recess 425 stops at the forward edge of the ball zone E. The combination of the recess 425 and the foam pad 421 with the outsole being relatively rigid, a discontinuity is provided in the ball zone E forward of the midfoot portion B providing the increased flexure as described above.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A woman's shoe construction including:

an upper shaped and sized to receive a foot portion of a wearer;

an outsole; and a composite structure positioned in overlying relation to at least a portion of the outsole and for support of a wearer's foot, said composite structure including a relatively rigid board member extending from a heel area to a forefoot area but stopping prior to a ball receiving area of the shoe, a first cushion member at the ball receiving area and connected to a front portion of the relatively rigid board member, said first cushion member having a plurality of perforations in the ball area, a second cushion member secured to an upper portion of the board in a heel receiving area of the shoe, said second cushion member being received in a recess extending only partially into the board, and a third cushion member overlying the board, first cushion member and second cushion member, wherein the relatively rigid board member is more rigid than at least the first cushion member.

2. The shoe of claim 1 including a spacer member secured to the board and having said recess therein, said recess being upwardly opening.

3. The shoe construction of claim 1 wherein said heel area of said outsole having a height of less than about 50 mm, said ball receiving area of said outsole having a width of at least about 0.3 times the length of the shoe; and said composite structure having a composite density of less than about 1 g/cc and greater than about 0.5 g/cc, said ball zone of the composite structure being more flexible than a midfoot portion of the composite structure, said first and second cushion members having a deformability of between about 10% and about 60% and said second cushion having a hardness of between about 61 and about 74 Shore O.

4. The shoe construction of claim 3 wherein the composite structure including an insole positioned between the outsole and the remainder of the composite structure.

5. The shoe construction of claim 4 wherein the composite structure including a sock liner.

6. The shoe construction of claim 3 wherein the ball zone of the rigid board member having a greater flexibility than the midfoot portion thereof.

7. The shoe construction of claim 1 wherein said heel area of said outsole having a height of less than about 50 mm, said composite structure having density of less than about 1 g/cc and more than about 0.5 g/cc, at least one of the composite structure and the outsole having a first discontinuity zone in the respective ball zone;

wherein said a second cushion member positioned in the first discontinuity zone in overlying relation to at least a portion of the outsole heel zone and having deformability of between about 10% and about 60% and a hardness of between about 61 and 74 Shore O.

8. The shoe construction of claim 7 wherein said first cushion member having density of less than about 1 g/cc and deformability of between about 10% and about 60% and a hardness of less than about 74 Shore O.

9. The shoe construction of claim 8 wherein the relatively rigid board member having a transversely extending first edge, said first cushion member extending forwardly of said first edge.

10. The shoe construction of claim 9 wherein the first cushion member having a transversely extending second edge forward of the first edge and including a second relatively rigid board member extending forwardly of the second edge into a toe zone of the shoe.

11. The shoe construction of claim 10 wherein the first cushion member extending substantially across an inside width of the shoe in the ball zone.

12. The shoe construction of claim 8 wherein at least one portion of the first and second cushion members comprising a polymeric foam.

13. The shoe construction of claim 8 wherein at least one of the first and second cushion members comprising a gel.

14. The shoe construction of claim 8 including a lining including a breathable lining material.

15. The shoe construction of claim 8 wherein the first cushion member having a plurality of perforations.

16. The shoe construction of claim 8 wherein the outsole being a unit molded outsole.

17. The shoe construction of claim 8 wherein the outsole being a formed outsole.

18. The shoe construction of claim 7 wherein a toe zone and the ball zone and heel zone demonstrate a pressure distribution of less than 55 pounds per square inch.

* * * * *